US006241131B1

(12) United States Patent
Katsuda et al.

(10) Patent No.: US 6,241,131 B1
(45) Date of Patent: Jun. 5, 2001

(54) DELAYED SPRAY ACTUATOR

(75) Inventors: Yoshio Katsuda, Nishinomiya; Hiroyuki Ueda, Chiyoda-ku, both of (JP)

(73) Assignee: Dainihon Jochugiku Co., Ltd., Osaka (JP)

( * ) Notice: Subject to any disclaimer, the term of this patent is extended or adjusted under 35 U.S.C. 154(b) by 0 days.

(21) Appl. No.: 09/550,422

(22) Filed: Apr. 17, 2000

(30) Foreign Application Priority Data

Apr. 19, 1999 (JP) ..... 11-148649

(51) Int. Cl.[7] ..... B65D 47/00
(52) U.S. Cl. ..... 222/477; 222/402.13
(58) Field of Search ..... 222/145.1, 145.5, 222/402.2, 402.13, 477

(56) References Cited

U.S. PATENT DOCUMENTS 2,899,113 * 8/1959 Forster et al. ..... 222/477
3,968,905 * 7/1976 Pelton ..... 222/477
5,702,036 * 12/1997 Ferrara, Jr. ..... 222/402.13

FOREIGN PATENT DOCUMENTS 9-150874 6/1997 (JP) .

* cited by examiner

*Primary Examiner*—Philippe Derakshani
*Assistant Examiner*—Thach H Bui
(74) *Attorney, Agent, or Firm*—Oliff & Berridge, PLC

(57) ABSTRACT

The present invention provides a delayed spray actuator for aerosol which is convenient for a user at the time of an ejection operation, that is simple in the entire construction, and that elongates a delayed time period. When a valve member 1 is depressed, the valve member 1, a cover member 5 and a stem 1 are moved downwardly to open a valve portion of the stem 10 and an outer sheath portion 7 is held in a state in which a protruded portion 7*a* thereof is engaged with a protruded portion 15*c* of a cover body 15. In this state, an end portion of a skirt portion 4*c* of a sheath-like responding portion 4 is closely contacted with a small diameter portion 6*b* of an inner circumferential surface of an inner cylinder portion 6, and a flow passage defined by a hole portion 6*e*, a groove portion 4*b*, and an output side hole portion 2*a* is closed. Then, the sheath-like responding portion 4 is moved upwardly by pressure of the content introduced, and the end portion of the skirt 4*c* is forced from the small diameter portion 6*b* into the large diameter portion 6*a*, upon which the end portion is released from the inner circumferential surface of the inner cylindrical portion 6 and the content flows through the clearance therebetween to the groove 4*b* and the output side hole portion 2*a*. Reference numeral 7*d* designates an ambient air sucking space portion. Such an example is also included that an ejection surface of the output side hole portion 2*a* is formed into a tapered shape of 5 to 20 degrees.

5 Claims, 10 Drawing Sheets

[Fig. 1]
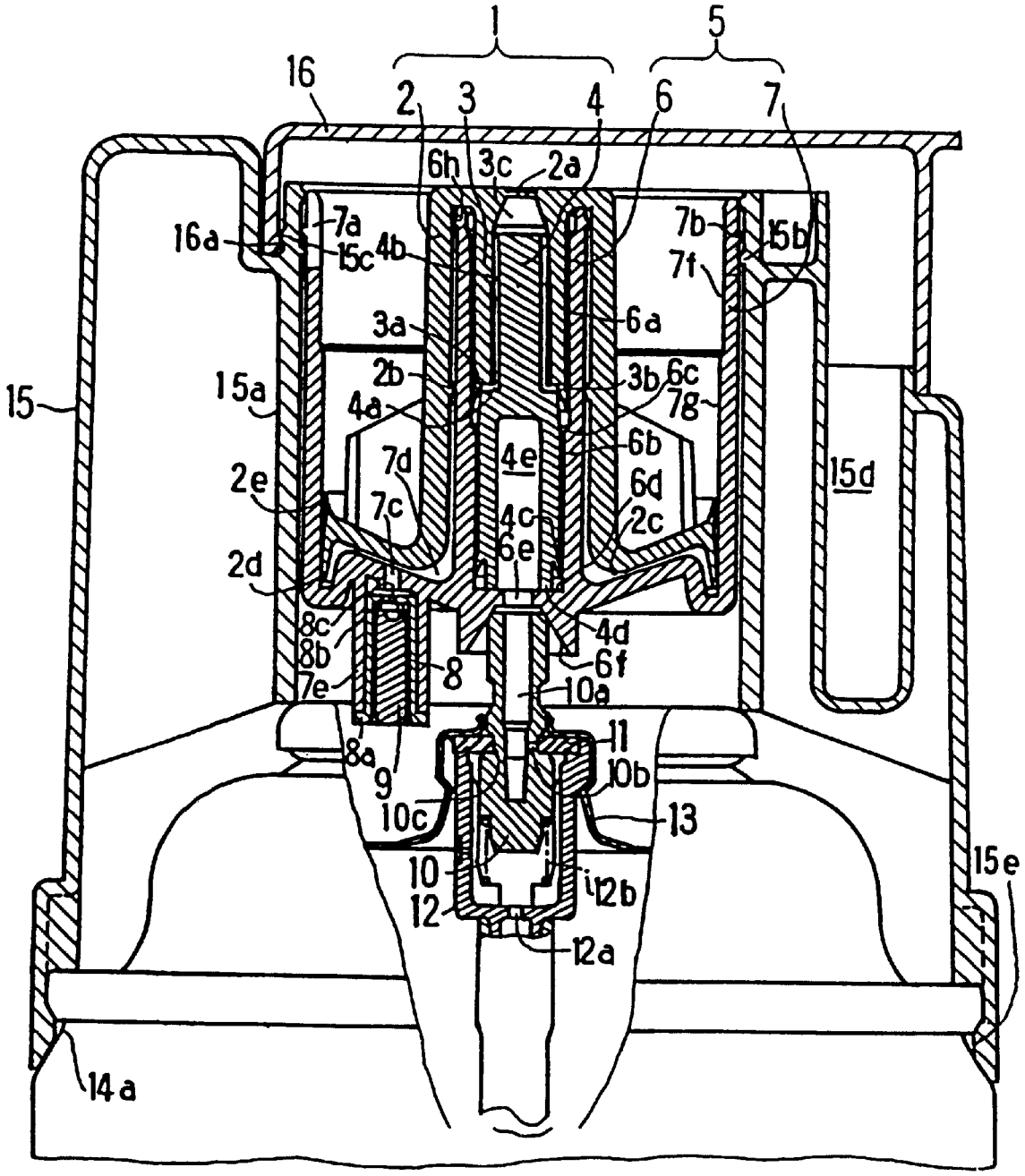

[Fig. 2]
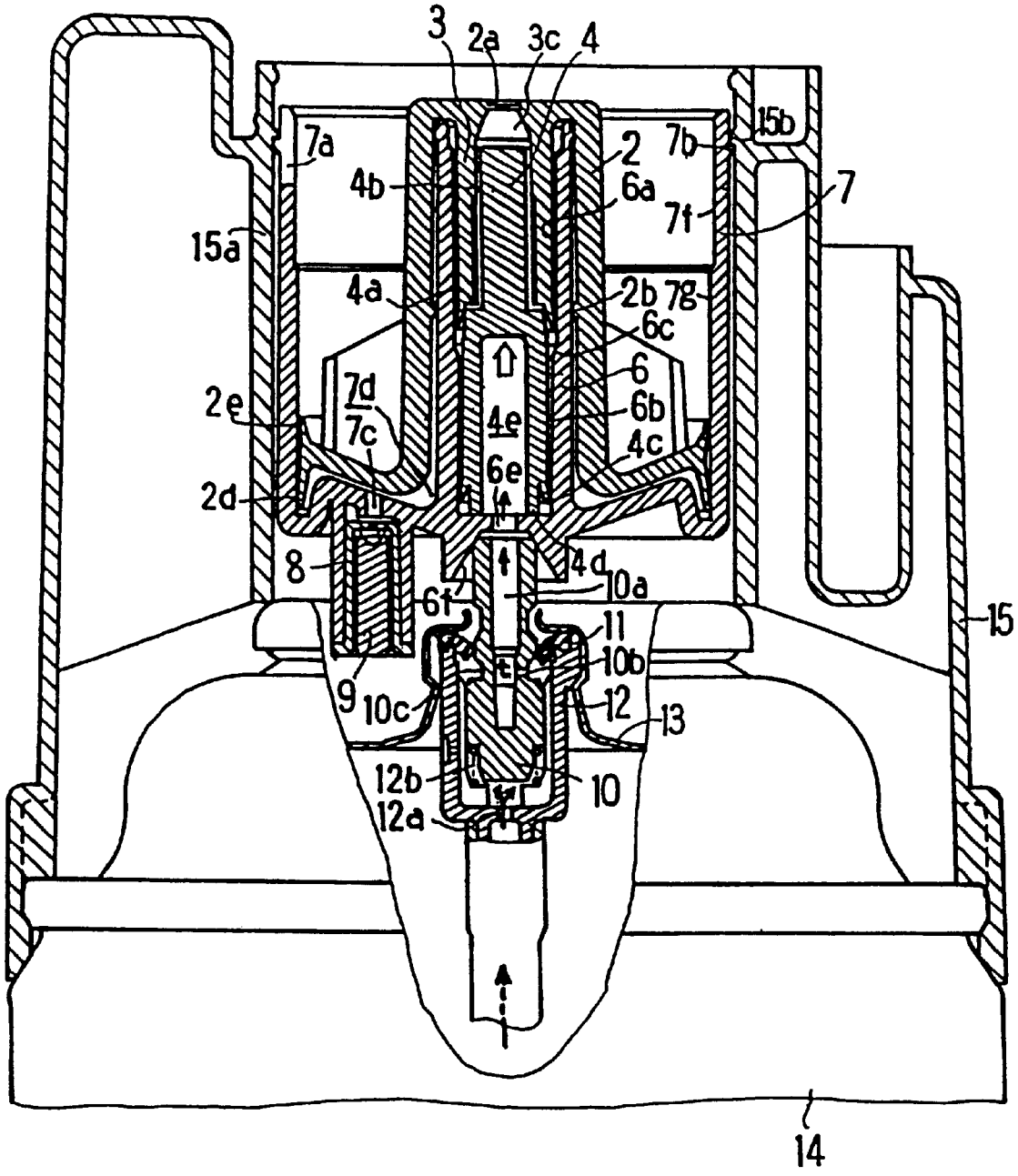

[Fig. 3]
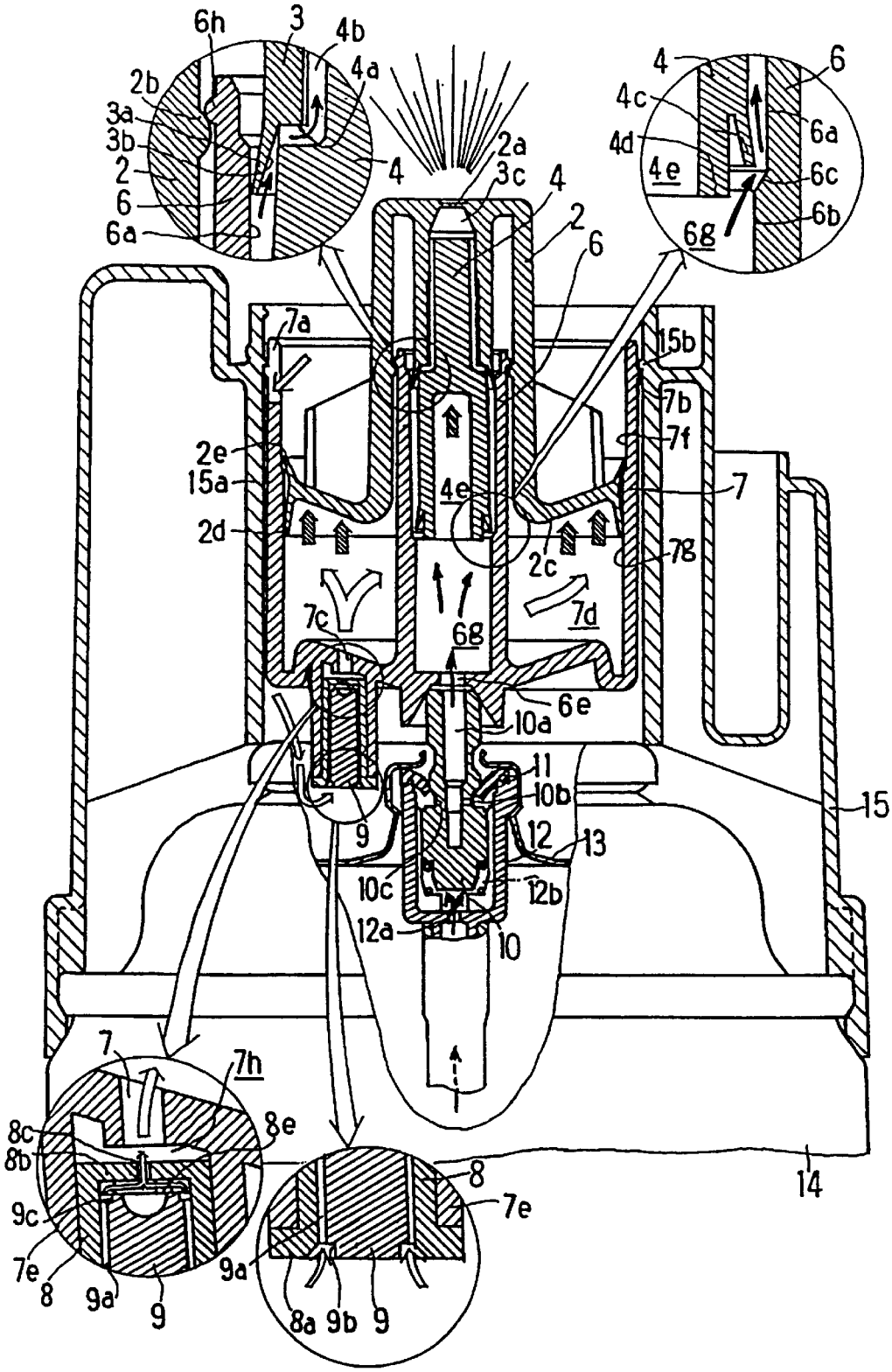

[Fig. 4]
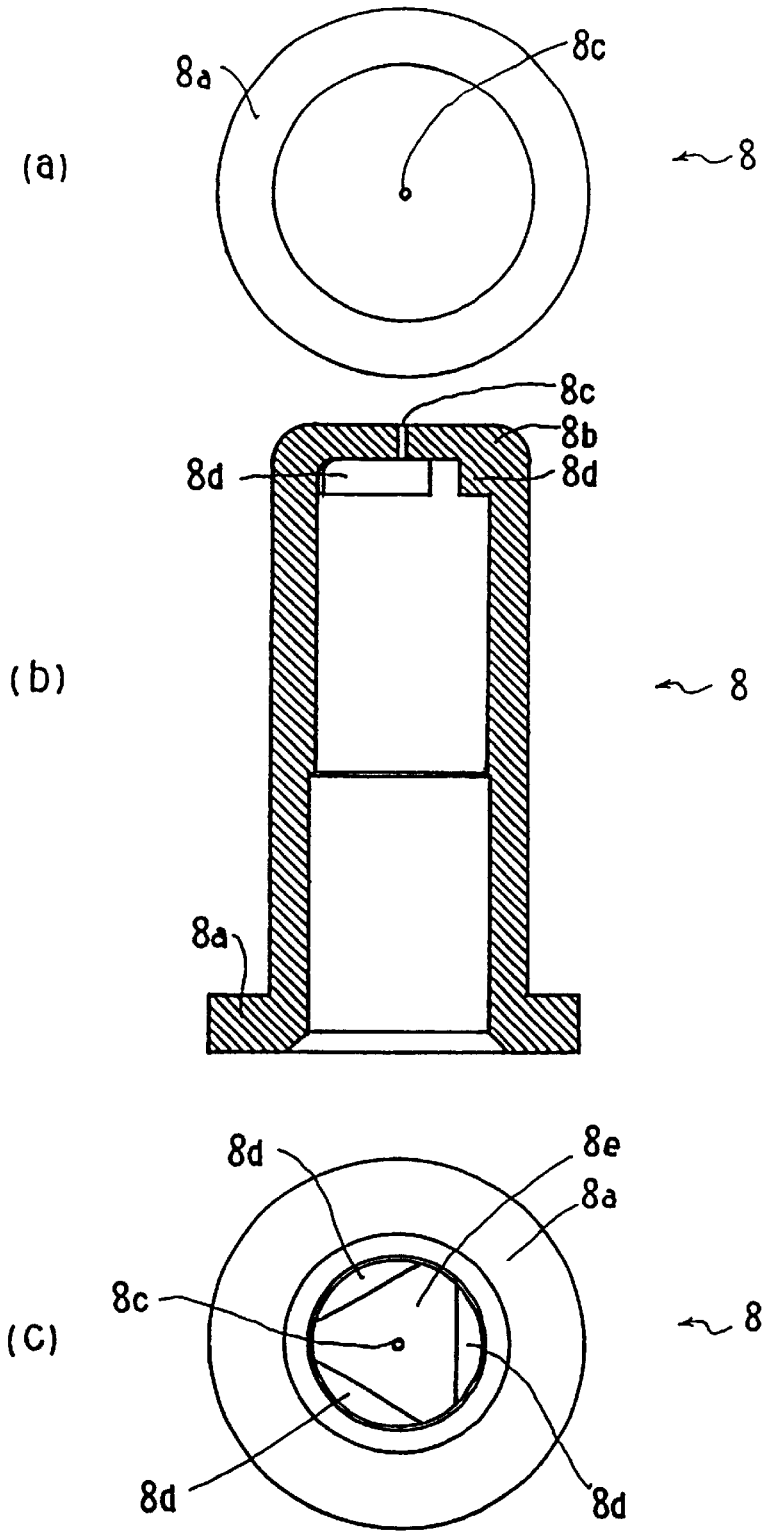

[Fig. 5]
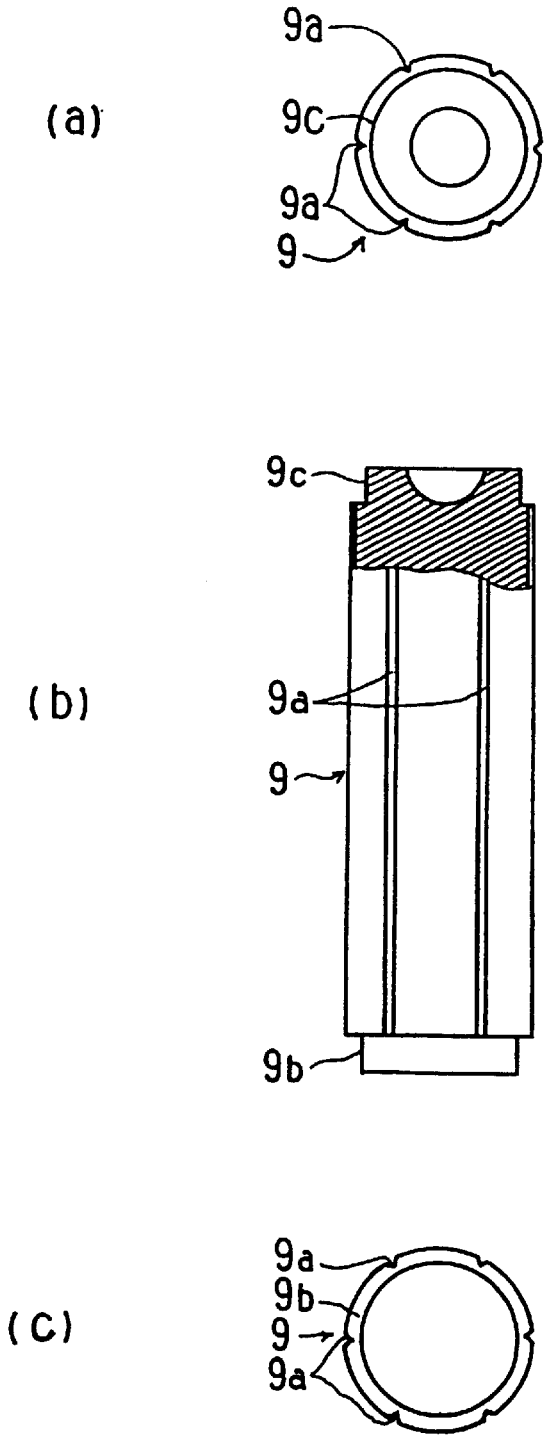

[Fig. 6]
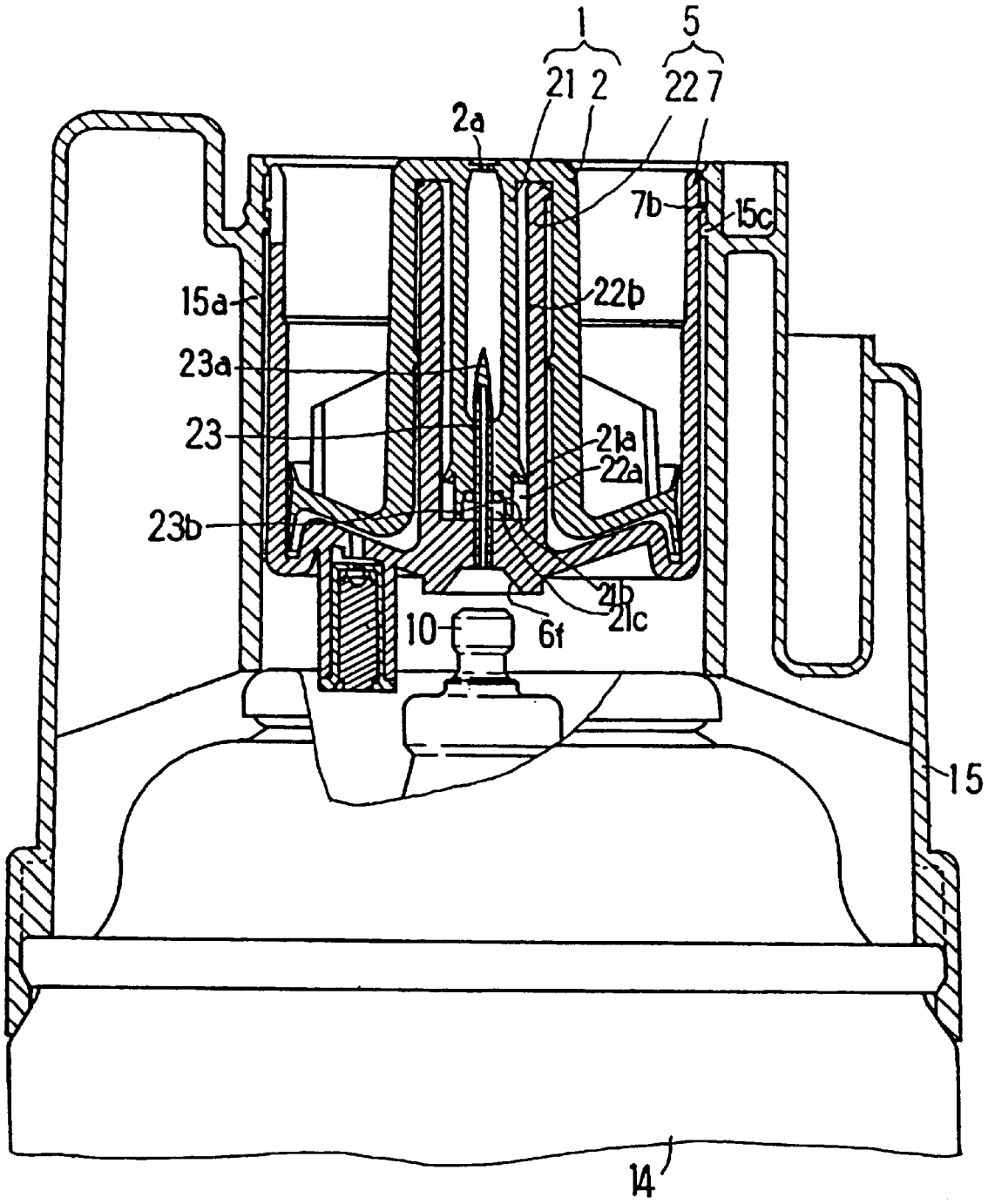

[Fig. 7]
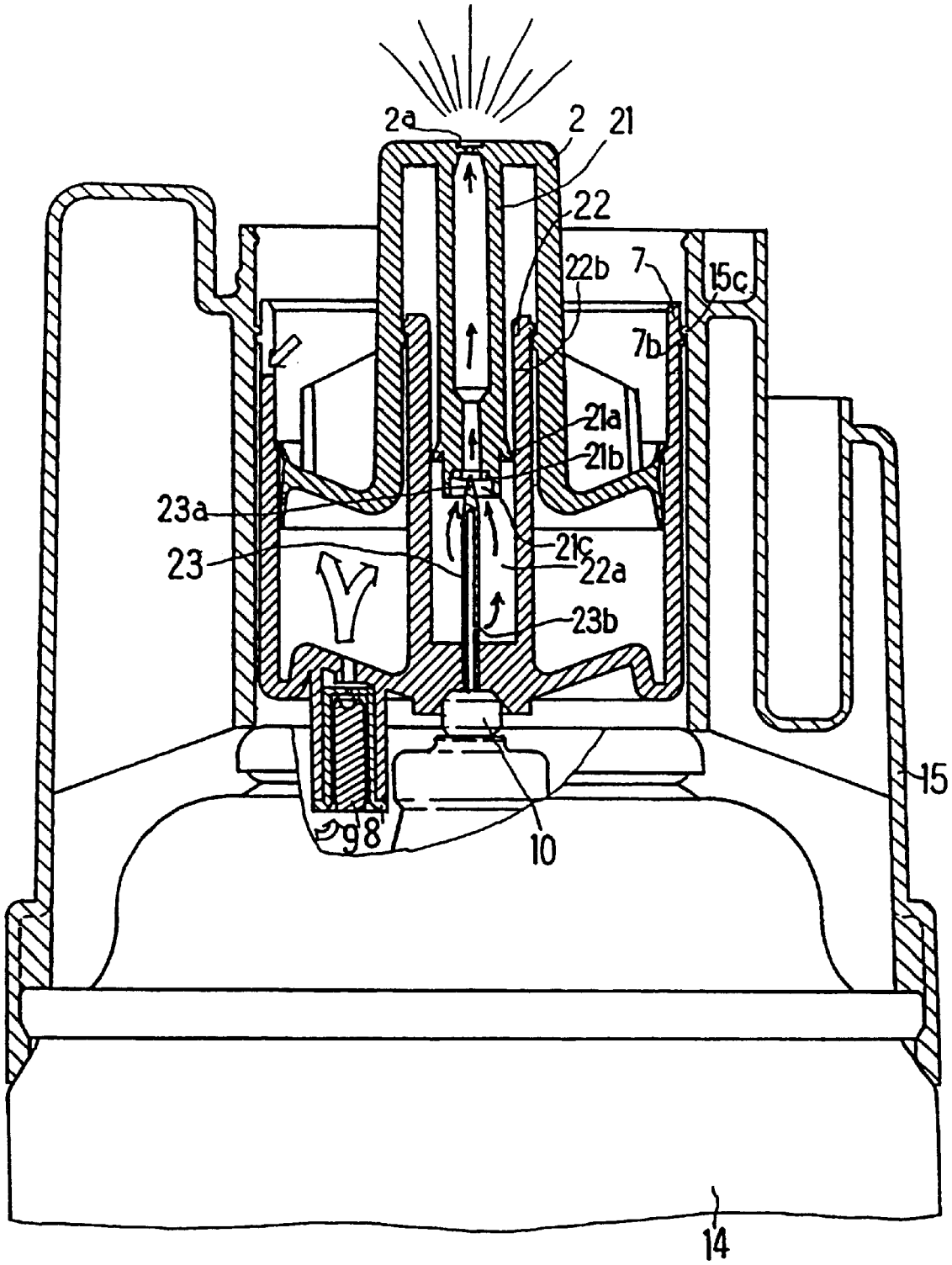

[Fig. 8]
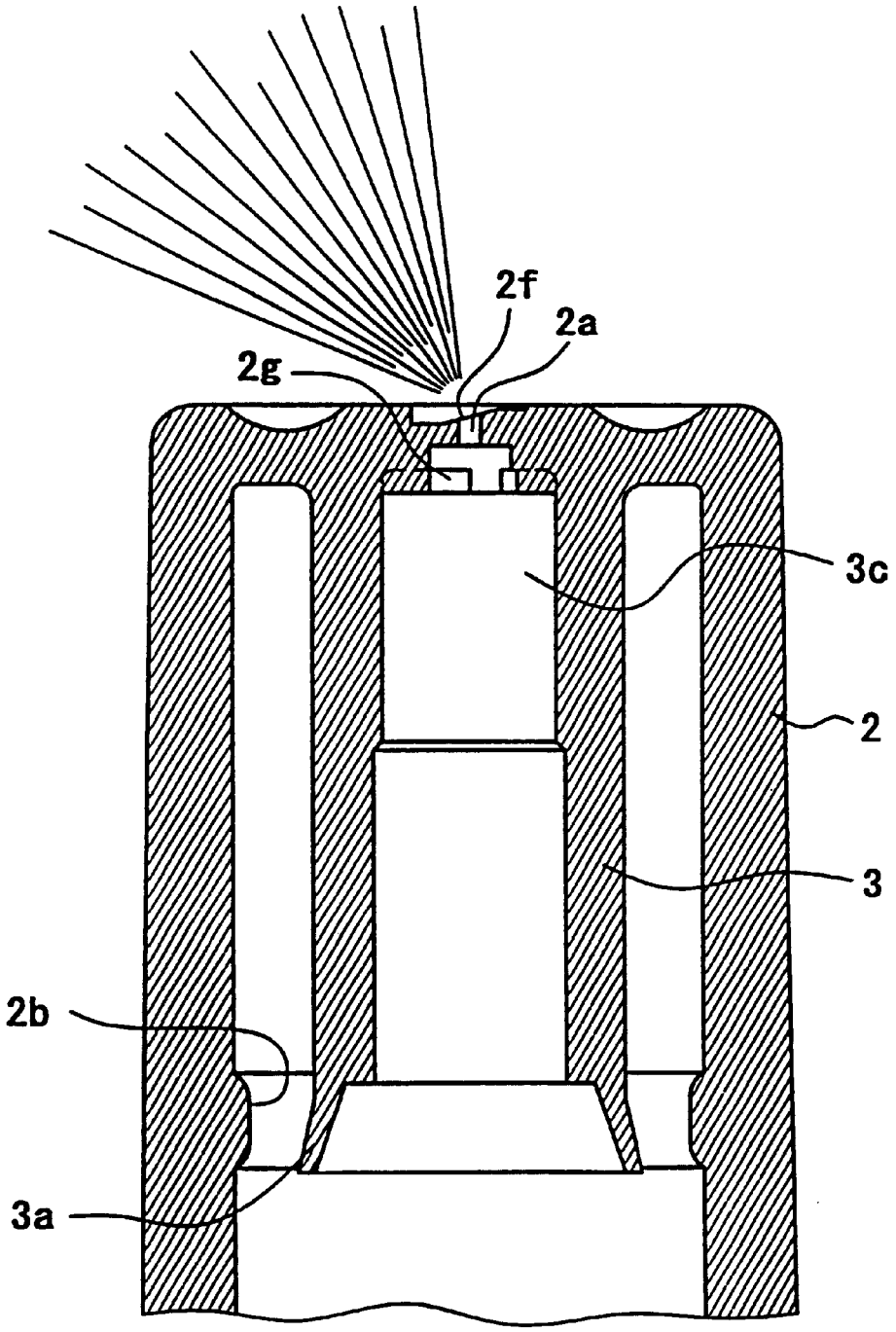

[Fig. 9]
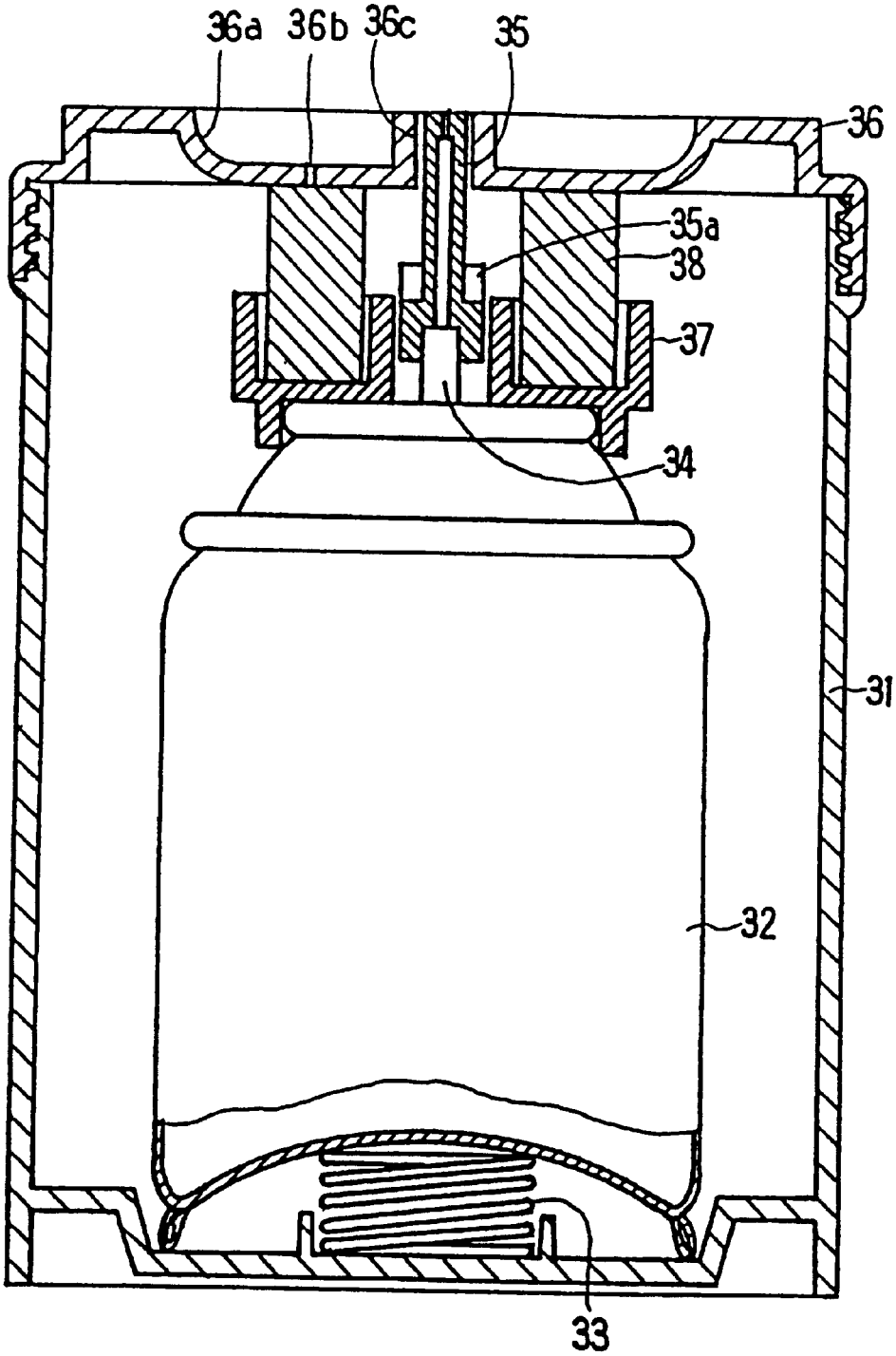

[Fig. 10]
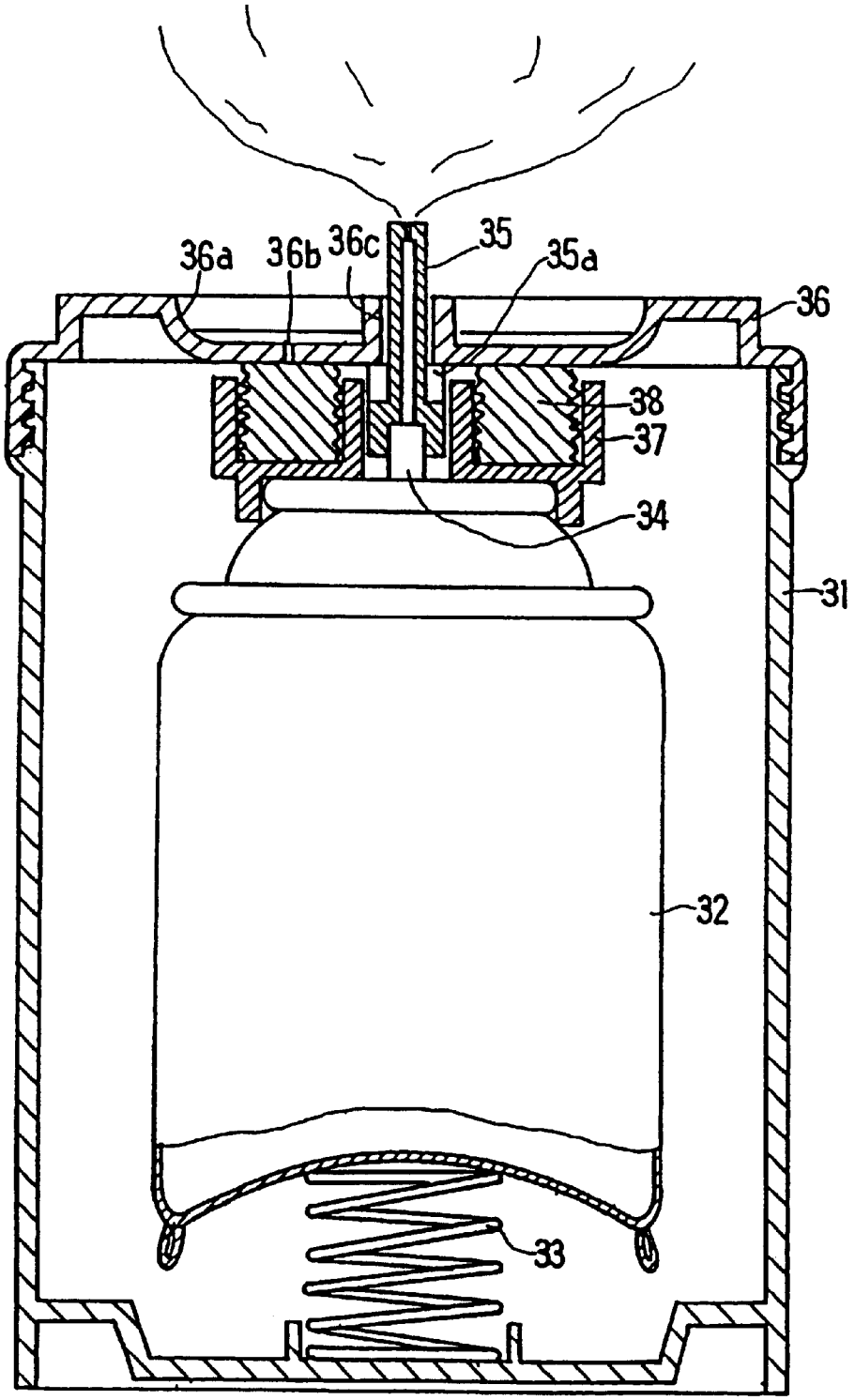

DELAYED SPRAY ACTUATOR

BACKGROUND OF THE INVENTION

1. Field of the Invention

The present invention relates to a delayed spray actuator, and in particular to a delayed spray actuator which starts ejecting a content (for instance, insecticide, disinfectant, etc.) of a container within a closed room after a predetermined time period has lapsed from an ejection operation, and which thereafter maintains the ejection of the content continuously.

In general, a container of such a type that ejects insecticide, disinfectant, or the like within a closed room is designed to provide a predetermined time difference from the ejection operation by a user to the start of the actual ejection motion so that the user can escape from the closed room.

In the case where the delayed ejection function of the content is added, it is desirable to assure the convenience to the user for the ejection operation, simplify the structure of the actuator per se, elongate the delayed time period, and make the ejection range wider. The present invention was made on these demands.

2. Description of Related Art

FIGS. 9 and 10 are explanatory views showing a conventional delayed spray actuator disclosed in Japanese Patent Application Laid-Open No. hei 9-150874. FIG. 9 shows a stationary state of the delayed spray actuator, and FIG. 10 shows an operation state of the delayed spray actuator.

In these Figures, reference numeral 31 designates a case main body; 32, a container set on the case main body 31; 33, a coil spring for urging the container 32 upwardly; 34, a stem provided with a valve portion (not shown); 35, a nozzle fitted into the stem 34; 35*a*, a plurality of ribs projectingly provided on the nozzle lower portion; 36, a lid member for the case main body 31; 36*a*, a water pouring recess portion formed in the upper surface side of the lid member 36; 36*b*, a through-hole formed in the water pouring recess portion 36*a*; 36*c*, a nozzle insertion hole formed in the upper surface central portion of the lid member 36; 37, a support frame fittingly attached to the upper end side of the container 32; and 38, a cylindrical porous member of a water-absorbing, softening characteristic, which is installed between the water pouring recess portion 36*a* and the support frame 37.

When the stem 34 is depressed relative to the container 32, the valve portion thereof is switched from a closed state to an open state so that the content in the container 32 is ejected from the leading end portion of the nozzle 35 to the exterior space.

In the stationary state shown in FIG. 9, the container 32 is depressed by the porous member 38 of a hard state the upper surface of which is, in turn, suppressed by the lid member 36. The porous member 38 is normally, i.e. in a state that it does not absorb water therein, hard enough to hold its geometry.

At this time, the container 32 and the stem 34 in a united state are moved downwardly against the biasing force of the coil spring as illustrated, and the valve portion of the stem 32 is maintained in the closed state.

To establish the operation state shown in FIG. 10, a user pours water into the water pouring recess portion 36*a* of the stationary state shown in FIG. 9.

The water poured into the water pouring recess portion 36*a* is moved downwardly from the through-hole 36*b* to permeate into and soften the porous member 38.

As the softening of the porous member 38 is progressed, the biasing force of the coil spring 33 becomes larger than the geometry holding force of the porous member per se. Consequently, the container 32 is moved upwardly by the biasing force while the porous member 38 is compressed to the lid member 36.

During the movement of the container 32, (1) from the start of the movement up to a state in which the ribs 35*a* of the nozzle 35 are brought into contact with the back surface portion of the lid member 36, the container 32 and the stem 34 are raised together without changing the relative position therebetween. Therefore, the valve portion of the stem 34 is maintained in the closed state.

(2) When the ribs 35*a* of the nozzle 35 are brought into contact with the back surface portion of the lid member 36, the stem 34 is stopped, and thereafter the container 32 and the support frame 37 are raised relative to the stem 34 thus stopped. Therefore, the valve portion of the stem 34 is put into the open state so that the content in the container 32 is ejected from the leading end portion of the nozzle 35, and the actuator is transferred to the operation state (continuously ejecting state) shown in FIG. 10.

In the delayed spray actuator shown in FIGS. 9 and 10, a time period is delayed, from the ejection operation completion in which the user completely pours the water into the water pouring recess portion 36*a* of FIG. 9, to the start of the ejection motion immediately after the ribs 35*a* of the nozzle 35 are brought into contact with the back surface portion of the lid member 36 as a consequence of the raising of the container 32, the stem 34 and the nozzle 35 by the softening action of the porous member 38 absorbing the water therein.

In the case of the delayed spray actuator described above, the user must prepare the water to be poured into the water pouring recess portion. Therefore, there is a problem in that it is inconvenient at the time of the delayed ejection operation.

The porous member, the coil spring (for raising up the container per se accommodating the content therein), and so on are required as components that are inherently unnecessary to constitute the content ejection mechanism. Therefore, there is another problem in that the number of components is increased to constitute the delayed spray actuator, resulting in the cost increase and complicated manufacture and assembly.

Accordingly, in accordance with the present invention, the components used as the content ejection mechanism are improved to make it possible to maintain the container per se in the stationary state, and carry out the delayed ejection operation without requiring the user to prepare anything other than the ejection mechanism. That is, an object of the present invention is to provide the improved utility at the time of the operation, to reduce the number of the components of the delayed spray actuator and to suppress the complicated manufacturing/assembling process.

Another object of the present invention is to make a content ejection area wider by forming an ejection surface of an output side hole portion as a slope surface having a predetermined angle.

Yet another object of the present invention is to secure a delayed time period sufficient to the user by adding components for enlarging the delayed time period from the completion of the ejection operation to the start of the actual ejection motion.

SUMMARY OF THE INVENTION

The present invention solve the problems in the following manner:

(1) A delayed spray actuator which starts ejecting a content of a container after a predetermined time period has lapsed from an ejection operation, and which thereafter maintains the ejection of the content continuously, said delayed spray actuator comprising: a valve member having an output side hole portion for ejection, the valve member being moved downwardly by the ejection operation, and upwardly by pressure of the content; a cover member having an accommodating space portion for the content, the cover member being moved downwardly by the ejection operation to be held at predetermined position, and serving as a guide portion when the valve member is moved upwardly; a stem that is moved downwardly together with the cover member to be communicated with an interior of the container and to maintain a communicated state; and an ejection valve mechanism for the output side hole portion, wherein the valve mechanism is adapted to be switched from an existing closed state to an open state when the valve member is moved upwardly by a predetermined length relative to the cover member located at the predetermined position by the action of the pressure of the content introduced into the accommodating space portion through the stem maintaining the communicated state, thereby communicating the interior of the container with the output side hole portion.

(2) The delayed spray actuator as set forth in (1), wherein the output side hole portion is formed to have an ejection surface inclined at a predetermined slope angle with respect to a horizontal plane. In addition, as described later, a preferable range for the predetermined slope angle is 5 to 20 degrees.

(3) The delayed spray actuator as set forth in (1) or (2), wherein: the cover member has an inner cylindrical portion corresponding to the accommodating space portion, and an outer sheath portion corresponding to an ambient air sucking space portion, and a part of the outer sheath portion is provided with an ambient air hole portion; the valve member has a valve function portion forming the valve mechanism and a ceiling surface portion forming the ambient air sucking space portion; and an upward movement of the valve function portion is guided by the inner cylindrical portion, and an upward movement of the ceiling surface portion is guided by the outer sheath portion.

(4) The delayed spray actuator as set forth in (3), wherein a dust removing member is provided to an input side of the ambient air hole portion.

(5) The delayed spray actuator as set forth in (3) or (4), wherein a sucking adjusting member for adjusting an amount of sucked ambient air is provided to an input side of the ambient air hole portion.

According to the present invention, as previously described in (1), the valve member, the cover member and the stem are first moved downwardly by the ejection operation of the user. Of these components, the cover member is held at a predetermined position to make the stem in communication with the interior of the container.

Then, the valve member is moved upwardly relative to the cover member thus held in the stationary state, so as to open the new valve mechanism, whereby the content is ejected. Therefore, it is possible to realize the delayed ejection operation simply by the depression operation, reduce the number of components, and simplify the manufacturing/assembling process.

As previously described in (2), since the ejection surface of the output side hole portion is formed as a slope surface, having, for instance, an angle of 5 to 20 degrees, the content is ejected from the output side hole portion with being shifted by the slope angle. As compared with a case where the content is ejected straightly and upwardly from the output side hole portion, the ejection performance is less influenced by sedimentary particles of the ejected content, and the floor surface is less wetted.

As previously described in (3), in association with the downward movement of the valve member, the ambient air is introduced into the space portion which is defined by the valve member and the cover member held in the stationary state. Therefore, the time period from the completion of the ejection operation to the start of the ejection motion, i.e. the time period required to returningly move upwardly the valve member once moved downwardly to put the valve mechanism into the open state, can be made longer.

As previously described in (4), the dust in the ambient air is prevented from entering into the ambient air sucking space portion.

As previously described in (5), the degree of sucking ambient air is adjusted with the sucking adjusting member on the input side of the ambient air sucking space portion. The use of this sucking adjusting member provides a more suitable delayed time period.

BRIEF DESCRIPTION OF THE DRAWINGS

In the accompanying drawings:

FIG. 1 is an explanatory view showing a stationary state of a delayed spray actuator according to a first embodiment of the present invention;

FIG. 2 is an explanatory view showing a state in which an ejection operation is completed in the delayed spray actuator according to the first embodiment of the present invention;

FIG. 3 is an explanatory view showing an operation state of the delayed spray actuator according to the first embodiment of the present invention;

FIGS. 4A to 4C are explanatory views showing a sheath-like sucking member assembled into an input side of an ambient air hole portion of an outer sheath portion according to the present invention, in which FIG. 4A is a plan view, FIG. 4B is a longitudinally sectional view, and FIG. 4C is a bottom view;

FIGS. 5A to 5C are explanatory views showing a columnar bushing fitted to the sucking member according to the present invention, in which FIG. 5A is a plan view, FIG. 5B is a partially, longitudinally sectional view, and FIG. 5C is a bottom view;

FIG. 6 is an explanatory view showing a stationary state of a delayed spray actuator according to a second embodiment of the present invention;

FIG. 7 is an explanatory view showing an operation state of the delayed spray actuator according to the second embodiment of the present invention; and FIG. 8 is an explanatory view showing a cap portion and so on in a case where an ejection surface of an output side hole portion is formed into a tapered shape.

DETAILED DESCRIPTION OF THE PREFERRED EMBODIMENTS

A first embodiment of the present invention will be described with reference to FIGS. 1 to 5.

FIG. 1 shows a stationary state of a delayed spray actuator, FIG. 2 shows an ejection operation completed state (an ejection operation starting state) of the delayed spray actuator, FIG. 3 shows an operation state of the delayed spray actuator, FIG. 4 shows a sheath-like sucking member to be assembled into the input side of an ambient air hold portion of an outer sheath portion, and FIG. 5 shows a columnar bushing to be fitted to the inside of the sucking member shown in FIG. 4.

In these drawings, reference numeral 1 designates a valve member.

Reference numeral 2 designates a cap portion, which is a component of the valve member 1, and which has a circular upper surface having a diameter of 10 mm or more, for instance, 20 mm. The cap portion 2 includes an output side hole portion 2*a* for ejection, a protruded portion 2*b* formed on an inner circumference of the cap portion 2 for being guided, a ceiling surface portion corresponding to a later described space portion 7d for suction of ambient air, a skirt portion 2*d* continuing to the ceiling surface portion 2*c*, an inverted-skirt portion 2*e* continuing to the ceiling surface portion 2*c*, a tapered ejection surface 2*f* of the output side hole portion 2*a*, and a rib 2*g*.

Reference numeral 3 designates a cylindrical suspended portion which is a component of the valve member 1 and which is formed integral with the cap portion 2. The cylindrical suspended portion 3 includes a skirt portion 3*a* on the lower end side of the cylindrical suspended portion 3, a tapered step portion 3*b* formed over the entire circumference of the skirt portion 3*a*, and a space portion 3*c* for the ejection of the content.

Reference numeral 4 designates a sheath-like responding portion, which is a component of the valve member 1 and which is moved vertically with pressure of the content. The responding portion 4 includes a intermediate step portion 4*a* formed over the entire circumferential surface of the sheath-like responding portion 4, content passing grooves 4*b* formed at four locations, each extending continuously in the vertical direction of the outer circumferential surface upper portion of the sheath-like responding portion 4 and in the radial direction of the intermediate step portion 4*a*, a skirt portion 4*c* (corresponding to a valve function portion) formed over the entire circumferential of the outer circumferential surface lower portion of the sheath-like responding portion 4, an opening side end portion 4*d*, and an internal space (corresponding to a content accommodating space portion 6*g*).

Reference numeral 5 designates a cover member.

Reference numeral 6 designates an inner cylindrical portion that constitutes the cover member 5. The inner cylindrical portion 6 includes a large diameter portion 6*a* on the inner circumferential surface of the inner cylindrical portion 6, a small diameter portion on the inner circumferential surface of the inner cylindrical portion 6, a slope portion 6*c* interposed between the large diameter portion 6*a* and the small diameter portion 6*b*, a lower side step portion 6*d* formed over the entire circumference of the outer circumferential surface lower portion of the inner cylindrical portion 6, a content passing hole portion 6*e*, a funnel portion 6*f*, the content accommodating space portion 6*g*, and an engaging protruded portion 6*h* formed on the outer circumferential surface upper portion of the inner cylindrical portion 6.

Reference numeral 7 designates an outer sheath portion which constitutes the cover member 5 and which is formed integrally with the inner cylindrical portion 6. The outer sheath portion 7 includes an ambient air taking-in slit portion 7*a* formed vertically in the inner circumferential surface upper portion of the outer sheath portion 7, an engaging protruded portion 7*b* formed circumferentially on the inner circumferential surface upper portion of the outer sheath portion 7, a hole portion for ambient air, which is formed on the bottom surface of the outer sheath portion 7, an ambient air sucking space portion 7*d* extending to the ambient air hole portion 7*c*, a fitting cylindrical portion 7*e* formed on the bottom surface side of the outer sheath portion 7, a small diameter portion 7*f* on the inner circumferential surface of the outer sheath portion 7, a larger diameter portion 7*g* on the inner circumferential surface of the outer sheath portion 7, and a clearance space 7*h*.

Reference numeral 8 designates a sheath-like sucking member which is fittingly attached to the cylindrical portion 7*e* of the outer sheath portion 7 so as to adjust the flow-in rate of the ambient air. The sheath-like sucking member 8 includes a flange portion 8*a*, a ceiling portion 8*b*, a suction hole portion 8*c* formed in the ceiling portion 8*b*, a plurality of bench-like step portions 8*d* each formed to project downwardly on the edge side of the back surface of the ceiling portion 8*b*, and a space portion 8*e* surrounded by the ceiling portion 8*b* and the bench-like step portions 8*d*.

Reference numeral 9 designates a columnar bushing that is fittingly attached to the sucking member 8 so as to prevent dust components in the ambient air from being introduced. The columnar bushing 9 includes a plurality of ambient air passing groove portions 9*a* formed vertically on the outer circumferential surface of the bushing 9, an upstream side step portion 9*b* formed over the entire circumference of the outer circumferential surface lower side reaching to the groove portion 9*a*, and a downstream side step portion 9*c* over the entire circumference of the outer circumferential surface upper side continuing from the groove portion 9*a*.

Reference numeral 10 designates a stem, which includes a content passage 10*a*, a lateral hole portion 10*b* and a recess portion 10*c* for holding a stem rubber described later.

Reference numeral 11 designates the stem rubber which serves as a valve of the lateral hole portion 10*b*.

Reference numeral 12 designates a housing for accommodating the stem 10, which includes a content input side hole portion 12*a*, and a coil spring 12*b* installed on the housing bottom portion to receive the stem 10.

Reference numeral 13 designates a mounting cap for holding and fixing the stem rubber 11 and the housing 12.

Reference numeral 14 designates a container main body, which has a constricted portion on the upper portion of the container main body 14.

Reference numeral 15 designates a cover body that is engaged with and attached to the container main body 14, which includes a cylindrical portion 15*a* for guiding and holding the cover member 5, an engagement protruded portion 15*b* formed on the inner circumferential surface of the cylindrical portion 15*a*, an engagement protruded portion 15*c* formed on the upper side outer circumferential surface of the cylindrical portion 15*a*, a manual accommodating portion 15*d* formed on the outer side of the cylindrical portion 15*a*, a protruded end portion 15*e* for engagement with the constricted portion 14*a* of the container main body upper portion.

Reference numeral 16 designates a cap to the cover body 15, which has a engagement protruded portion 16*a* formed on the inner circumferential surface of the cap 16.

Each of the guided protruded portion 2*b*, the engagement protruded portions 6*h*, 7*b*, 15*b*, 15*c*, 16*a* and so on may be formed over the entire circumference or on a part of the associated circumference surface as desired. Further, the number of the output side hole portion 2*a*, the rib 2*g*, the slit portion 7*a* or the like may be selected in an arbitrary manner. Moreover, the slope angle (with respect to the horizontal plane) of the tapered ejection surface 2*f* of the output side hole portion 2*a* may be selected in an arbitrary manner, but preferably set to be 5 to 20 degrees.

In the specification, the "skirt portion" means a circumferential surface in which the lower side is larger in diameter than the upper side, whereas the "inverted skirt portion" means a circumferential surface in which the upper side is larger in diameter than the lower side.

Further, the upstream side of the flow of the content (closer to the container body 14) is expressed as "down", whereas the downstream side of the flow of the content (closer to the output side hole portion 2*a* of the valve member 1) is expressed as "up".

The cylindrical suspended portion 3 and the sheath-like responding portion 4 are tightly fitted by the tapered step portion 3*b*, and these components and the cap portion 2 are all assembled as an integral unit of the valve member 1.

The inner cylindrical portion 6 and the stem 10 are tightly fitted by the funnel portion 6*f*, and the cover member 5 (the inner cylindrical portion 6 and the outer sheath portion 7) and the stem 10 are all assembled as an integral unit.

In the valve body 1, the protruded portion 2*b* of the cap portion 2 is brought into contact with the outer circumferential surface of the inner cylindrical portion 6, for instance, over the entire circumference, the ends of the skirt portion 2*d* and inverted skirt portion 2*e* of the cap portion 2 are brought into close contact with the inner circumferential surface of the outer sheath portion 7 over the entire circumference (in case of FIGS. 1 and 2), the end of the skirt portion 3*a* of the cylindrical suspended portion 3 is brought into close contact with the large diameter portion 6*a* of the inner circumferential surface of the inner cylindrical portion 6 over the entire circumference, and the end of the skirt portion 4*c* of the sheath-like responding portion 4 is brought into close contact with the small diameter portion 6*b* of the inner circumferential surface of the inner cylindrical portion 6 over the entire circumference.

In the cover member 5, the protruded portion 7*b* of the outer sheath portion 7 is brought into contact with the inner circumferential surface of the cylindrical portion 15*a* of the cover body 15.

Accordingly, the cover member 5 (the inner cylindrical portion 6 and the outer sheath portion 7) is assembled as an integral unit that is vertically movable while being guided by the cylindrical portion 15*a* of the cover body 15.

When the lateral hole portion 10*b* of the stem 10 is opened, the valve member 1 (the cap portion 2, the cylindrical suspended portion 3 and the sheath-like responding portion 4) receives the pressure of the content flowing into the sheath-like responding portion 4, and therefore is moved upwardly as a unit while being guided by the cover member 5.

The content flows from the container main body 14 to the output side hole portion 2*a* of the valve member 1 briefly through 1) the input side hole portion 12*a* of the housing 12,
2) the clearance portion between the inner circumferential surface of the housing 12 and the outer circumferential surface of the stem 10,
3) the lateral hole portion 10*b* of the stem 10,
4) the passage 10*a* of the stem 10,
5) the hole portion 6*e* of the inner cylindrical portion 6,
6) the accommodating space portion 6*g* of the inner cylindrical portion 6 (the internal space 4*e* of the sheath-like responding portion 4),
7) the clearance portion between the skirt portion 4*c* of the sheath-like responding portion 4 and the large diameter portion 6*a* of the inner circumferential surface of the inner cylindrical portion 6,
8) the groove portions 4*b* of the sheath-like responding portion 4, and
9) the space portion 3*c* of the cylindrical suspended portion 3, in this order.

In the stationary state shown in FIG. 1, the stem 10 is biased upwardly by the action of the coil spring 12*b* and thus stabilized at the illustrated position, the stem rubber 11 closes the upstream side opening portion of the lateral hole portion 10*b* of the stem 10, the protruded portion 7*b* of the outer sheath portion 7 is located upwardly of the engagement protruded portion 15*b* of the cylindrical portion 15*a*, the valve member 1 is held in a state in which the opening side end portion 4*d* of the sheath-like responding portion 4 is in contact with the lower side step portion 6*d* of the inner cylindrical portion 6 (the skirt portion 4*c* of the sheath-like responding portion 4 is closely contacted with the small diameter portion 6*b*of the inner circumferential surface of the inner cylindrical portion 6, and the ends of the skirt portion 2*d* and inverted skirt portion 2*e* of the cap portion 2 are closely contacted with the inner circumferential surface of the outer sheath portion 7), and the protruded portion 16*a* of the cap 16 is held in such a state as to be engaged with the protruded portion 15*c* of the cover body 15.

In this state, since the above-mentioned 3) and 7) parts are not secured in the flow passage of the content, no content flows from the container main body 14 to the output side hole portion 2*a* of the valve member 1.

To eject the content, it suffices that a user removes the cap 16 from the cover body 15 such that the user depresses the upper surface portion of the valve member 1 (the peripheral portion around the output side hole portion 2*a* of the cap portion 2). In addition, the cap 16 and the cover body 15 are made of synthetic resin to ease the removal operation.

In association with this depressing operation, (1) the valve body 1 (the cap portion 2, the cylindrical suspended portion 3 and the sheath-like responding portion 4) and the cover member 5 (the inner cylindrical portion 6 and the outer sheath portion 7) are moved together downwardly, (2) the stem 10 integral with the inner cylindrical portion 6 is also moved downwardly, and the stem rubber 11 is deformed as shown in FIG. 2, so that the upstream side opening portion of the lateral hole portion 10*b* of the stem 10 is put into an opened state, and (3) the cover member 5 which has been moved downwardly is brought into a state in which the protruded portion 7*b* of the outer sheath portion 7 is positioned downwardly of the protruded portion 15*b* of the cylindrical portion 15*a* and engaged therewith. In addition, the outer sheath portion 7 and the cylindrical portion 15*a* are made of synthetic resin, so that the protruded portion 7*b* is surely moved downwardly of the protruded portion 15*b* of the cylindrical portion 15*a* and held at that position.

Consequently, the above-mentioned 3) part is secured in the content flow passage, and therefore the content is introduced through the passage 10*a* of the stem 10 and the hole portion 6*e* of the inner cylindrical portion 6 into the internal space 4*e* of the sheath-like responding portion 4 (see FIG. 2).

The pressure of the introduced content causes the sheath-like responding portion 4 to be moved upwardly while being kept in a state in which the end of the skirt portion 4*c* is closely contacted with the small diameter portion 6*b* of the inner circumferential surface of the inner cylindrical portion 6 (which cannot be moved upwardly because of the engagement of the protruded portion 7*b* of the outer sheath portion 7 with the protruded portion 15*c* of the cylindrical portion 15*a*).

During this movement, since the above-mentioned 7) part can not be secured in the content flow passage as long as the skirt portion 4*c* of the sheath-like responding portion 4 is kept in close contact with the small diameter portion 6*b* of the inner cylindrical portion 6, the content which has been introduced into the internal space 4*e* of the sheath-like responding portion 4 and the accommodating space portion 6*g* of the inner cylindrical portion 6 (see FIG. 3) can not reach to the grooves 4*b* of the sheath-like responding portion 4.

After a time has lapsed from the depression operation by the user, and after a time point at which the end of the skirt portion 4*c* of the sheath-like responding portion 4 has reached from the smaller diameter portion 6*b* of the inner cylindrical portion 6 to the slope portion 6*c* thereof, the above-mentioned 7) part is secured, that is, the content flow passage to the output side hole portion 2*a* is completely formed (see FIG. 3).

In addition, the upward movement of the sheath-like responding portion 4 relative to the inner cylindrical portion 6 is continued until the protruded portion 2*b* of the inner circumferential surface of the cap portion 2 associated therewith is brought into engagement with the protruded portion 6*h* of the inner cylindrical portion 6 (see FIG. 3).

In this manner, the ejection motion is delayed by an amount periodically corresponding to a time period from the start of the depression operation to the time point at which the above-mentioned 7) part is secured in the content flow passage.

The length of this delayed time period can be set as desired by adjusting the configuration, size and weight of the valve member 1, the degree of close contact between the valve member 1 and the cover member 5, the vertical length of the smaller diameter portion 6*b* of the inner cylindrical portion 6, the configuration and size of the sheath-like responding portion 4, etc.

An ambient air is introduced to the outer circumferential surface of the inner cylinder portion 6, and the space portion 7*d* between the outer sheath portion 7 and the ceiling surface portion 2*c* of the cap portion 2 in association with the upward movement of the sheath-like responding portion 4 so as to elongate the delayed time period.

That is, the outer sheath portion 7 is added as an object to be raised by the pressure of the content in addition to the sheath-like responding portion 4 and the inner cylindrical portion 6 that are directly related to formation of the content flow passage extending from the above-mentioned 1) to 9) parts so as to provide the increased resistance against the increased content (pressure) that is introduced as a power source for the delayed ejection motion, thereby lowering the moving speed of the sheath-like responding portion 4.

The ambient air introducing passage is briefly defined by: the slit portion 7*a* of the outer sheath portion 7, the clearance between the inner circumferential surface of the cylindrical portion 15*a* and the outer circumferential surface of the outer sheath portion 7, the upstream side step portion 9*b* of the bushing 9, the groove 9*a* of the bushing 9, the downstream side step portion 9*c* of the bushing 9, the space portion 8*e* of the sucking member 8, and the sucking hold portion 8*c* of the sucking member 8 in this order.

In addition, the sucking member 8 is forced upwardly so as to be fitted into the cylindrical portion 7*e* of the outer sheath portion 7.

The sucking member 8 in the fitted state is brought at its flange portion 8*a* into contact with the lower end portion of the cylindrical portion 7*e* while creating the clearance portion 7*h* between its ceiling portion 8*b* and the bottom surface (the ambient air hole portion 7*c*) of the outer sheath portion 7.

The bushing is forced upwardly so as to be fitted into the sucking member 8, and the upper surface portion of the bushing 9 (continuous to the downstream side step portion 9*c*) is brought into contact with the bench-like step portions 8*d* on the back surface of the ceiling portion 8*b* of the sucking member 8.

Provision of the bushing 9 within the sucking member 8 prevents dust and so on in the introduced ambient air from entering into the ambient air sucking space portion 7*d* as well as adjusts the degree of the introduced ambient air, for instance, such that the quantity of the introduced ambient air per unit time period is lowered.

That is, the ratio of the pressure increase in the space portion 7*d* is made small so as to elongate the delayed time period in which the end portion of the skirt portion 4*c* of the sheath-like responding portion 4, that is set into the state shown in FIG. 2 by the depression operation of the user, is raised up to the ejection motion starting state shown in FIG. 3.

In the case where this adjustment function is not taken into consideration, a filter may be provided within the sucking member 8.

As shown in FIG. 3, the end portion of the skirt portion 4*c* of the sheath-like responding portion 4 is transferred from the small diameter portion 6*b* of the inner circumferential surface of the inner cylindrical portion 6 to the large diameter portion 6*a* thereof, and concurrently (i.e. substantially at the same timing), the end portion of the inverted skirt portion 2*e* of the cap portion 2 is transferred from the small diameter portion 7*g* of the inner circumferential surface of the outer sheath portion 7 to the large diameter portion 7*f* thereof, so that the contact end portion and the contact inner circumferential surface are placed into a non-contact state.

This reduces the resistance (against upward movement) of the valve member as much as possible at the time when the valve member 1 is to start the ejection motion, so as to shorten the transient or transferring time period required for securing the above-mentioned 7) part in the content flow passage, thereby making the content ejection start motion sharp.

FIGS. 6 and 7 shows a second embodiment of the present invention. FIG. 6 shows a stationary state of a delayed spray actuator, and FIG. 7 shows an operation state of the delayed spray actuator.

Reference numerals newly used in FIGS. 6 and 7 are: a cylindrical responding portion 21, a skirt portion 21*a*, a rubber-made annular valve 21*b*, a lower space 21*c*, an inner cylindrical portion 22 forming the cover member 5, an accommodation space 22*a* for the content, an inner circumferential surface 22*b*, a sheath-like rod portion 23, an upper end (tapered) portion 23*a* of the sheath-like rod portion, and a lateral hole portion 23*b*. The other reference numerals in FIGS. 6 and 7 are common to FIGS. 1 to 5.

Differences of the delayed spray actuator from that shown in FIGS. 1 to 5 are:

the cylindrical responding portion 21 is formed integrally with the cap portion 2 forming the valve member 1, the skirt portion 21*a* is formed in the cylindrical responding portion 21, and the rubber-made annular valve 21*b* is provided to the lower space 21*c* of the cylindrical responding portion 21, the inner circumferential surface 22*b* of the inner cylindrical portion 22 (the content accommodation space 22*a*) forming the cover member 5 has a substantially constant diameter entirely over the vertical direction, the sheath-like rod portion 23 is provided to the inner cylindrical portion 22, the upper end portion 23*a* there of is tapered, and the lateral hole portion 23*b* is formed therein, the valve function is conducted between the annular valve 21*b* and the sheath-like rod portion 23, the end portion of the skirt portion 21*a* of the cylindrical responding portion 21 is closely contacted with the inner circumferential surface 22*b* of the inner cylindrical portion 22 regardless of the vertical position thereof, the stem 10 is not fitted to the inner cylindrical portion 22, and so on. In addition, the annular valve 21*b* corresponds to the valve function portion, and the lower space 21*c* also corresponds to the content accommodation space 22*a*.

With this delayed spray actuator, it suffices that the upper surface portion of the valve member 1 is depressed, and in association with the depression operation,

(11) the valve member 1 (the cap portion 2 and the cylindrical responding portion 21) and the cover member 5 (the inner cylindrical portion 22 and the outer sheath portion 7) are moved together downwardly,

(12) the stem 10 is depressed by the inner cylindrical portion 22 to deform the stem rubber 11 and to close the upstream side opening portion of the lateral hole portion 10*b* of the stem 10 (see FIG. 2), and

(13) in the cover member 5, the protruded portion 7*b* of the outer sheath portion 7 is located downwardly of the protruded portion 15*c* of the cylindrical portion 15*a* and engaged therewith (see FIG. 2).

At this stage where the depression operation by the user is completed, the cylindrical responding portion 21 and the inner cylindrical portion 22 are kept in the same positional relationship as the stationary state. Here, the annular valve 21*b* is closely contacted with the outer circumferential surface of the sheath-like rod portion 23.

Subsequently, the cylindrical responding portion 21 is moved upwardly by the pressure action of the content that is introduced through the stem 10, the sheath-like rod portion 23, and the lateral hole portion 23*b* into the lower space 21c and the accommodation space 22*a*.

Then, the cylindrical responding portion 21 is raised up to a position indicated in FIG. 7, and when the annular valve 21b is spaced from the outer circumferential surface of the sheath-like rod portion 23, the content passes through the clearance portion therebetween to be ejected from the output side hold portion 2*a*.

The delayed time period in this case corresponds to a time period for the movement of the cylindrical responding portion 21 from a time point at which the depression operation is completed to a time point at which the annular valve 21*b* is raised up to a range where it is forced into the tapered upper end portion 23*a* of the sheath-like rod portion 23.

Other constituent elements and other functions of the delayed spray actuator shown in FIGS. 6 and 7 are similar to those of the delayed spray actuator shown in FIGS. 1 to 5.

FIG. 8 shows the cap portion and so on when an ejection surface of the output side hole portion is formed into a tapered shape.

Here, the cap portion 2 has one output side hole portion 2*a* or two output side hole portions 2*a*, each having an ejection surface 2*f* whose slope angle is preferably 5 to 20 degrees (with respect to the horizontal plane).

Three ribs 2*g* are formed in the upstream side space of the output side hole portion 2*a*.

The inner sides of the ribs 2*g* are offset from the center of the upstream side space in the same fashion, and the flow of the content passing through these ribs toward the ejection surface 2*f* of the output side hole portion 2*a* is made vortex. As illustrated, the content is ejected to a wide range while being shifted leftwardly.

In addition, each of the ribs 2*g* may be formed to extend radially with respect to the center of the upstream side space of the output side hole portion 2*a*.

As described above, according to the present invention, the valve member, the cover member and the stem are first moved downwardly by the ejection operation of the user. Of these components, the cover member is held at a predetermined position to make the stem in communication with the interior of the container. Then, the valve member is moved upwardly relative to the cover member thus held in the stationary state, so as to open the new valve mechanism, whereby the content is ejected. Therefore, it is possible to realize the delayed ejection operation simply by the depression operation, reduce the number of components, and simplify the manufacturing/assembling process.

Since the ejection surface of the output side hole portion is formed as a slope surface, the content is ejected from the output side hole portion with being shifted by the slope angle. As compared with a case where the content is ejected straightly and upwardly from the output side hole portion, the ejection performance is less influenced by sedimentary particles of the ejected content, and the floor surface is less wetted.

Once the valve member is moved downwardly by the ejection operation, the valve member is moved upwardly and in association therewith the ambient air is introduced into the space portion which is defined by the valve member and the cover member held in the stationary state. Therefore, the delayed time period from the completion of the ejection operation to the start of the ejection motion, i.e. the time period required for the upward movement of the valve member to put the valve mechanism into the open state, can be made longer.

Since the dust removing member is provided to the input side of the ambient air sucking space portion, it is possible to prevent the dust in the ambient air from entering into the space portion.

Since the sucking adjusting member is provided to the input side of the ambient air sucking space portion, a more suitable delayed time period can be secured.

What is claimed is:

1. A delayed spray actuator which starts ejecting a content of a container after a predetermined time period has lapsed from an ejection operation, and which thereafter maintains the ejection of the content continuously, said delayed spray actuator comprising:

a valve member having an output side hole portion for ejection, the valve member being moved downwardly by the ejection operation, and upwardly by pressure of the content;

a cover member having an accommodating space portion for the content, the cover member being moved downwardly by the ejection operation to be held at predetermined position, and serving as a guide portion when the valve member is moved upwardly;

a stem that is moved downwardly together with the cover member to be communicated with an interior of the container and to maintain a communicated state; and an ejection valve mechanism for the output side hole portion, wherein the valve mechanism is adapted to be switched from an existing closed state to an open state when the valve member is moved upwardly by a predetermined length relative to the cover member located at the predetermined position by the action of the pressure of the content introduced into the accommodating space portion through the stem maintaining the communicated state, thereby communicating the interior of the container with the output side hole portion.

2. The delayed spray actuator as set forth in claim 1, wherein the output side hole portion is formed to have an ejection surface inclined at a predetermined slope angle with respect to a horizontal plane.

3. The delayed spray actuator as set forth in claim 1 wherein:

the cover member has an inner cylindrical portion corresponding to the accommodating space portion, and an outer sheath portion corresponding to an ambient air sucking space portion, and a part of the outer sheath portion is provided with an ambient air hole portion;

the valve member has a valve function portion forming the valve mechanism and a ceiling surface portion forming the ambient air sucking space portion; and an upward movement of the valve function portion is guided by the inner cylindrical portion, and an upward movement of the ceiling surface portion is guided by the outer sheath portion.

4. The delayed spray actuator as set forth in claim 3, wherein a dust removing member is provided to an input side of the ambient air hole portion.

5. The delayed spray actuator as set forth in claim 3 wherein a sucking adjusting member for adjusting an amount of sucked ambient air is provided to an input side of the ambient air hole portion.

* * * * *